US012805585B1

(12) United States Patent
Leogrande

(10) Patent No.: US 12,805,585 B1
(45) Date of Patent: Nov. 24, 2026

(54) HOODED GARMENT WITH EYE COVER AND METHOD OF MANUFACTURE

(71) Applicant: Comfrt, LLC, Miami, FL (US)

(72) Inventor: Hudson Leogrande, Miami, FL (US)

(73) Assignee: Comfrt, LLC, Miami, FL (US)

( * ) Notice: Subject to any disclaimer, the term of this patent is extended or adjusted under 35 U.S.C. 154(b) by 0 days.

(21) Appl. No.: 19/542,365

(22) Filed: Feb. 17, 2026

Related U.S. Application Data

(63) Continuation of application No. 19/400,864, filed on Nov. 25, 2025.

(51) Int. Cl.
*A41D 1/04* (2006.01)
*A41D 1/02* (2006.01)
*A41D 3/00* (2006.01)

(52) U.S. Cl.
CPC ..... *A41D 1/04* (2013.01); *A41D 3/005* (2013.01); *A41D 1/02* (2013.01); *A41D 3/00* (2013.01); *A41D 2200/20* (2013.01)

(58) Field of Classification Search
CPC ..... A41D 1/04; A41D 1/02; A41D 2200/20; A41D 3/005; A42B 1/018; A42B 1/0181; A42B 1/0182
USPC ..... D2/828
See application file for complete search history.

(56) References Cited

U.S. PATENT DOCUMENTS 1,097,530 A * 5/1914 Cabelinsky ..... A41D 3/02 2/202
1,167,379 A * 1/1916 Buckman ..... A42B 1/045 2/203
1,482,270 A * 1/1924 Shuster ..... A42B 1/203 2/205
2,262,522 A * 11/1941 Yant ..... A61M 16/06 128/200.27
2,500,982 A * 3/1950 Fligel ..... A41B 3/00 2/84
3,561,010 A * 2/1971 Little ..... A42B 1/046 2/84

(Continued)

FOREIGN PATENT DOCUMENTS

CN 207721236 U 8/2018
CN 108471822 B 5/2020

(Continued)

OTHER PUBLICATIONS https://latesundayafternoon.com/products/apollo-hoodie; Retrieved from internet Sep. 10, 2025, 16 pages.

(Continued)

*Primary Examiner* — Alissa J Tompkins
*Assistant Examiner* — Raquel M. Weis
(74) *Attorney, Agent, or Firm* — Esplin & Associates, PC

(57) ABSTRACT

A hooded garment with eye cover is described herein. The hooded garment may comprise a hood and eye cover. The eye cover may be affixed to an inner fabric layer of the hood such that the eye cover may be set back from a perimeter portion of the hood forming a hood opening. A method of manufacture of a hooded garment with eye cover may comprise one or more of forming a shoulder yoke; forming a hood; affixing the hood to the shoulder yoke; forming an eye cover; affixing the eye cover to an inner fabric layer of the hood at a cover seam; and/or other operations.

17 Claims, 5 Drawing Sheets

(56) References Cited

U.S. PATENT DOCUMENTS 4,422,184 A * 12/1983 Myers ..... A01K 55/00 2/84
4,768,235 A * 9/1988 Webster ..... A42C 5/04 2/205
5,473,778 A * 12/1995 Bell ..... A42B 1/247 2/10
5,546,604 A * 8/1996 Geller ..... A42B 1/046 2/202
D384,189 S 9/1997 Tobias
5,713,077 A * 2/1998 Humbrecht ..... A42B 1/0182 2/202
5,845,340 A * 12/1998 Frislie ..... A42B 1/046 2/202
6,397,395 B1 * 6/2002 DeHart ..... A41D 3/005 2/202
7,657,954 B1 * 2/2010 Bunkers ..... A47C 7/383 5/639
8,726,421 B2 * 5/2014 Alvarez ..... A41D 13/0512 5/636
D708,822 S * 7/2014 Douglas ..... D2/880
D759,350 S * 6/2016 Sørensen ..... D2/831
9,521,873 B1 * 12/2016 Mignone ..... A41D 3/005
D784,658 S * 4/2017 Adrovic ..... D2/731
9,706,801 B2 * 7/2017 Hunkele ..... A41D 3/04
D801,009 S 10/2017 Woodle
D812,858 S 3/2018 Lamprey
D843,689 S 3/2019 Kinnear
10,259,363 B2 * 4/2019 Torres ..... B60N 2/882
D881,518 S * 4/2020 Buonocore ..... D2/831
D894,539 S 9/2020 Park
D896,001 S 9/2020 Estorco
10,791,775 B2 * 10/2020 Grogro ..... A41D 31/02
D903,981 S 12/2020 Wood
D906,633 S * 1/2021 Paradise ..... D2/728
D917,829 S * 5/2021 Guo ..... D2/718
D935,747 S * 11/2021 Storm ..... D2/878
D955,783 S * 6/2022 Estorco ..... D6/601
D967,605 S 10/2022 Cao
D967,606 S 10/2022 Cao
D967,607 S 10/2022 Liu
D990,098 S * 6/2023 Thurswell ..... D2/831
D996,779 S * 8/2023 Wen ..... D2/828
D1,008,606 S 12/2023 Willis
D1,030,249 S 6/2024 Sarria
D1,040,435 S 8/2024 Steffens
12,446,695 B2 * 10/2025 Saeliu ..... A47C 7/383
D1,101,360 S 11/2025 Phillips
2005/0160514 A1 * 7/2005 Flaniken ..... A41D 3/005 2/84
2006/0117450 A1 * 6/2006 Matsumoto ..... A63B 33/00 2/10
2006/0288465 A1 * 12/2006 Delorenzo ..... A41D 3/005 2/84
2008/0120762 A1 * 5/2008 Huang ..... A41D 3/00 2/202
2008/0250538 A1 * 10/2008 Saladino ..... G02C 5/008 2/10
2013/0205471 A1 * 8/2013 Alvarez ..... A41D 13/0512 2/202
2013/0340142 A1 * 12/2013 Saladino ..... A42B 3/185 2/202
2014/0096305 A1 * 4/2014 Friesen ..... A41D 1/04 2/84
2015/0026863 A1 * 1/2015 Elsmo ..... A47G 9/066 2/84
2015/0143604 A1 * 5/2015 Mizrahi ..... A42B 1/048 2/84
2015/0250240 A1 * 9/2015 Hunkele ..... A41D 15/04 2/86
2016/0374415 A1 * 12/2016 Chang ..... A41D 15/00 2/69
2017/0216099 A1 * 8/2017 Saladino ..... A42B 1/247
2017/0224033 A1 * 8/2017 Latta, Jr. ..... A47G 9/1045
2017/0320413 A1 * 11/2017 Knapp ..... B60N 2/882
2018/0007995 A1 * 1/2018 Morales ..... A41D 1/04
2018/0271189 A1 * 9/2018 Hussey ..... A41D 13/012
2018/0343950 A1 * 12/2018 Brandt ..... A41D 3/02
2019/0208936 A1 * 7/2019 Thomas ..... A47G 9/0223
2020/0093195 A1 * 3/2020 Whitaker ..... A61F 9/045
2021/0267291 A1 * 9/2021 Mayer ..... A41D 27/201
2022/0378137 A1 * 12/2022 Hayes ..... A42B 1/008
2022/0400782 A1 * 12/2022 Lindsay ..... A41D 13/001
2023/0131245 A1 4/2023 Larocca
2023/0389629 A1 * 12/2023 Garneau ..... A41D 13/001
2024/0225141 A1 * 7/2024 Stackhouse ..... A41D 3/02

FOREIGN PATENT DOCUMENTS

CN 212393892 U 1/2021
CN 214509515 U 10/2021

OTHER PUBLICATIONS https://pondla.com/products/essential-hoodie-rose;Retrieved from internet Sep. 10, 2025, 9 pages.
IFNOW Wearable Blanket Hoodie, announced Jul. 12, 2024 [online], [site visited Mar. 25, 2026]. Available from internet, URL: <https://www.amazon.co.uk/IFNOW-Wearable-Blanket-Oversized-Sweatshirt/dp/B0D2KH2PVW) (Year: 2024).
Airplane Mode Travel Hoodie, reviewed 2025 [online], (retrieved May 13, 2026). Retrieved from the internet, https://comfrt.com/products/travel-hoodie?variant=45536201769004 (Year: 2025) 9 pages.
Apollo Hoodie, reviewed Apr. 9, 2026 [online], (retrieved May 13, 2026). Retrieved from the internet, https://latesundayafternoon.com/ products/apollo-hoodie?variant=29971948175457&utm_source=google& (Year. 2025) 10 pages.

* cited by examiner

HOODED GARMENT WITH EYE COVER AND METHOD OF MANUFACTURE

FIELD OF THE DISCLOSURE

This disclosure relates to garment design and manufacture, and in particular to a hooded garment with eye cover.

BACKGROUND

Garment design may be guided by one or more of comfort, style, ease-of-manufacture, and/or durability.

SUMMARY

One or more aspects of the present disclosure relate to a hooded garment with an eye cover. Hooded garments offer comfort and functionality to its wearers. Some wearers choose hooded garments for airplane travel, since a deployed hood may help to block out some light, cover one's ears and reduce ambient noise, and generally provide comfort on an otherwise uncomfortable mode of travel. However, traditional hooded garments do little to cover the eyes entirely or even partially, which may be desired if a wearer intends to sleep while wearing the garment.

The hooded garment of the present disclosure may address one or more problems with traditional hooded garments by providing an integrated (e.g., affixed) eye cover. The eye cover may be affixed in a way that provides improvements not only to functionality of covering a wearer's eyes when deployed, but also achieve desired levels of comfort, style, ease-of-manufacture, and/or durability.

A hooded garment of the present disclosure may comprise one or more of a hood, a shoulder yoke, a body, and/or other components. The shoulder yoke may have an opening formed for a neck of a wearer. The shoulder yoke may sit on the shoulders of a wearer in an as-used mode of the hooded garment. The hooded garment may have a left side and a right side divided by a garment sagittal plane. The left side of the body may include a left sleeve for receiving a left arm of a wearer. The right side of the body may include a right sleeve for receiving a right arm of a wearer.

The hood may be affixed to the shoulder yoke. The hood may be formed by one or more of an inner fabric layer, an outer fabric layer, perimeter portion, and/or other components. The inner fabric layer and outer fabric layer may be affixed at a hood seam and/or other seams. The perimeter portion may extend from the hood seam to a perimeter edge. The perimeter edge and/or perimeter portion may define a hood opening. The hood may have a hood sagittal centerline aligned with the garment sagittal plane.

The hood may have an eye cover. The eye cover may be affixed to the inner fabric layer of the hood at a cover seam. The cover seam may not be visible from an exterior side of the outer fabric layer. The eye cover may have a cover sagittal centerline aligned with the garment sagittal plane. The eye cover may be affixed to the inner fabric layer such that the cover sagittal centerline may be aligned with the hood sagittal centerline. The eye cover may have a deployed mode wherein the eye cover covers the eyes of the wearer in the as-used mode of the garment. The eye cover may have a stored mode wherein the eye cover is laid against the inner fabric layer. In the stored mode, the eye cover may be positioned between the inner fabric layer and a top of a wearer's head. In some implementations, the eye cover may transition from the deployed mode to the stored mode (and vice versa) based on rotation about the cover seam.

The eye cover may be affixed to the inner fabric layer such that the eye cover may be set back from the perimeter portion. By way of non-limiting illustration, a setback of the eye cover from the perimeter portion may cause the cover seam formed by affixation of the eye cover to the inner fabric layer to be separate and distinct from the hood seam.

A method of manufacture of a hooded garment with eye cover may comprise one or more of forming a shoulder yoke; forming a hood; affixing the hood to the shoulder yoke; forming an eye cover; affixing the eye cover to an inner fabric layer of the hood at a cover seam; and/or other operations.

The shoulder yoke may have an opening formed for a neck of a user. The shoulder yoke may have a left side and a right side divided by a garment sagittal plane.

The hood may have an inner fabric layer and an outer fabric layer affixed at a hood seam. The hood may further have a perimeter portion extending from the hood seam to a perimeter edge defining a hood opening. The hood may have a hood sagittal centerline aligned with the garment sagittal plane.

The eye cover may have a cover sagittal centerline aligned with the garment sagittal plane. The eye cover may be affixed such that the cover sagittal centerline is aligned with the hood sagittal centerline. The eye cover may be affixed such that the eye cover is set back from the perimeter portion. The cover seam formed by affixation of the eye cover to the inner fabric layer may be separate and distinct from the hood seam.

As used herein, any association (or relation, or reflection, or indication, or correspondence) involving components of a garment that interacts with any other component of the garment and/or plays a part in the operation of the garment, may be a one-to-one association, a one-to-many association, a many-to-one association, and/or a many-to-many association or N-to-M association (note that N and M may be different numbers greater than 1). As used herein, the phrase "configured to" is intended to be interpreted broadly, as "being capable of or suitable for performing" some function or feature, without requiring any adaptations to provide said function or feature.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
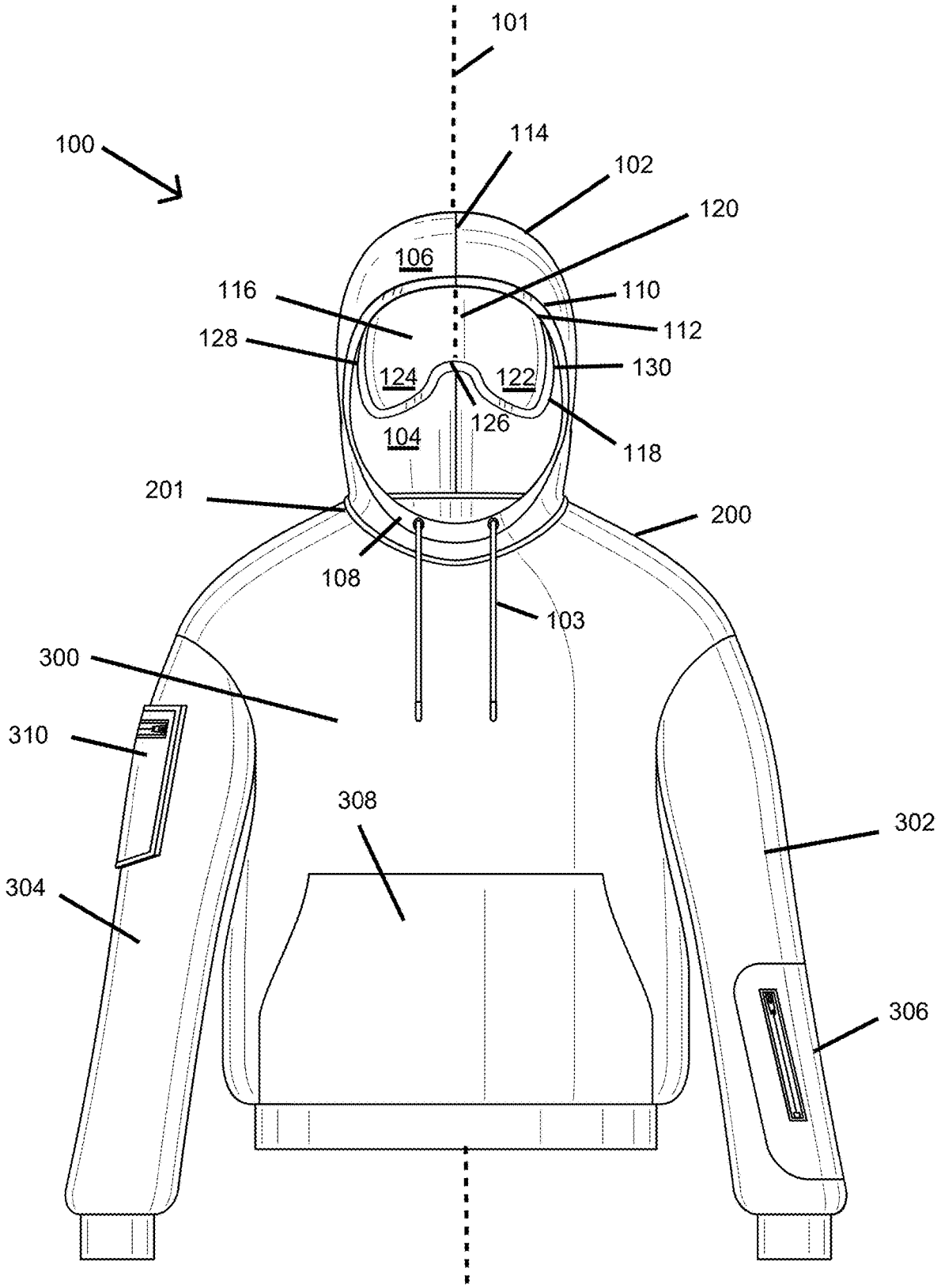
FIG. 1 illustrates a front view of a hooded garment with eye cover, in accordance with one or more implementations.

FIG. 1 illustrates a view of a hooded garment 100, in accordance with one or more implementations. The hooded garment 100 may be formed from material suitable for the intended purposes. By way of non-limiting illustration, hooded garment 100 may be formed from fabric such as one or more cotton, cotton blends, flannel, denim, linen, corduroy, and/or other fabrics. The hooded garment 100 of the present disclosure may address one or more problems with traditional hooded garments by providing an integrated (e.g., affixed) eye cover 116. The eye cover 116 may be affixed in a way that provides improvements not only to functionality of covering a wearer's eyes when deployed, but also achieve desired levels of comfort, style, ease-of-manufacture, and/or durability. Some implementations of the hooded garment 100 may be described with respect to an as-use mode, which may refer to the hooded garment 100 being worn by a wearer.

It is noted that terms such as "posterior", "anterior", "forward", "rearward", "front", "back", "upper", "lower", "top", "bottom", "sagittal", "transverse", "distal", "proximal", "left", and/or "right" may refer herein to the directions and/or dispositions when considering the hooded garment 100 in the as-mode as a piece of clothing worn by a wearer. The use of these terms with various components should therefore be easily understood by a person skilled in the art as related to orientation, direction, and/or disposition. Further, some directions may be specifically defined herein and/or shown in the figures.

The inventor of the present disclosure has identified one or more critical dimensions and/or one or more critical relative dimensions of the hooded garment 100 that allows the hooded garment 100 to achieve the results and/or improvements related to eye covering functionality, comfort, style, ease-of-manufacture, and/or durability. Such dimensions may be expressed in a variety of ways. By way of non-limiting illustration, dimensions may be expressed as one or more of specific values, ranges of values, relative values, and/or in other ways. It is to be understood that the way in which the dimensions are expressed should not diminish the criticality thereof in achieving the aforementioned results and/or improvements.

Dimensions described herein may refer to dimensions of cloth taken when the cloth is unstretched so that the fabric is not under tension or compression, unless specified otherwise.

It is further noted that some numerical values for dimensions may be expressed herein with the term "about." Those skilled in the art of garment design and/or manufacture may understand the impact of this term as it is used and/or understood within the scope of their knowledge and/or experience in the field. In some implementations, a meaning of the term "about" may be specifically described herein with respect to a given value expression. In some implementations, in lieu of and/or in addition to any specifically expressed meanings of the term "about," this term may be understood as being +/−1% of an aforementioned value. Further, when a value is expressed with respect to a range, this may be considered inclusive of the specified range values.

Figure 2:
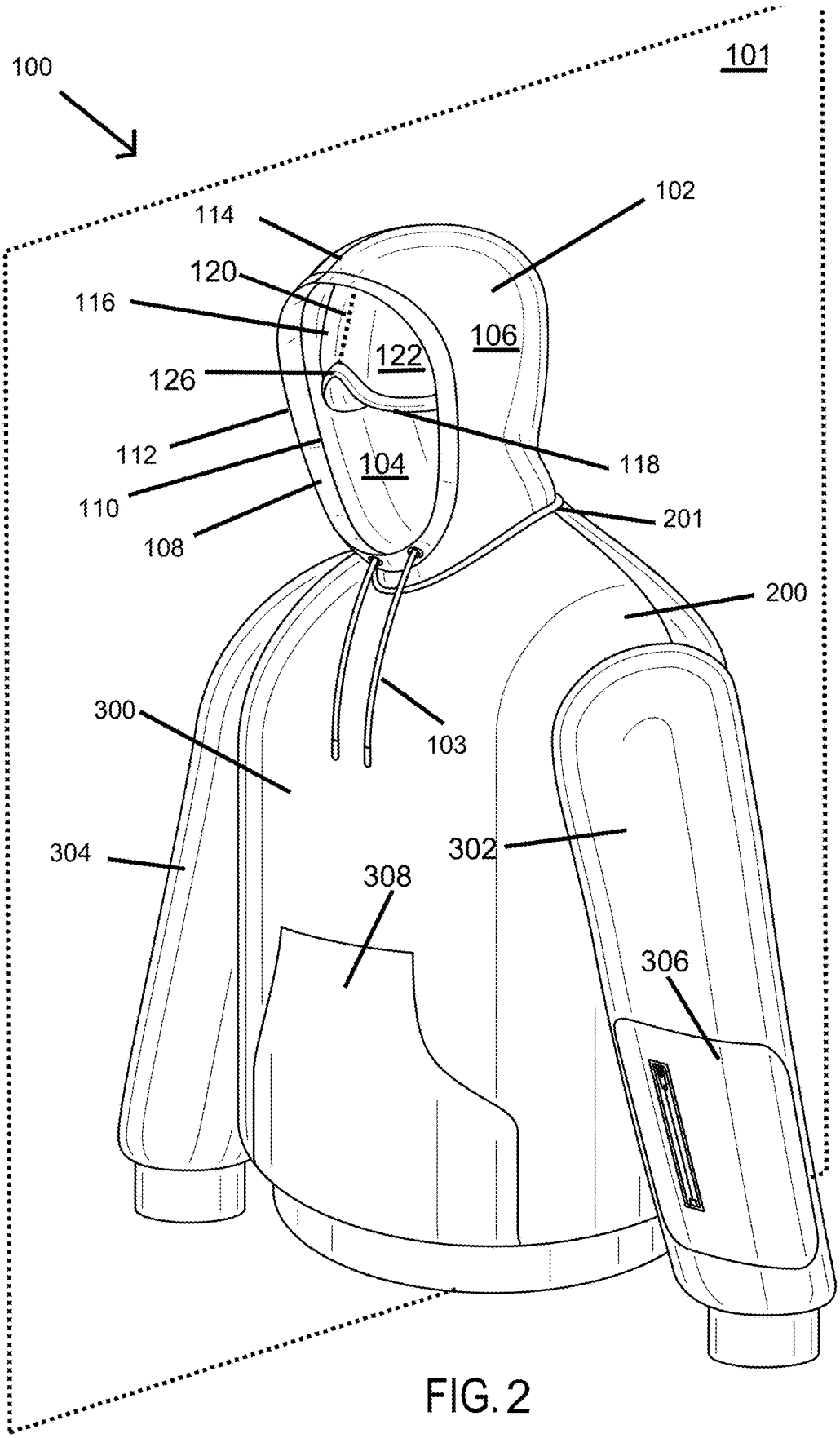
FIG. 2 illustrates a perspective view of the hooded garment, in accordance with one or more implementations.

FIGS. 1 and 2 show views of the hooded garment 100, with like reference numerals referring to like components. FIG. 1 shows a front view. FIG. 2 shows a perspective view. The hooded garment 100 may comprise one or more of a hood 102, a shoulder yoke 200, a body 300, and/or other components.

The shoulder yoke 200 may have an opening formed for a neck of a user. The shoulder yoke 200 may sit on the shoulders of a user, and may have a left side and a right side divided by a garment sagittal plane 101 (illustrated by a dashed line in FIG. 1). The garment sagittal plane 101 described herein may refer to an imaginary plane and/or line that may not be realized in any particular form on the garment 100 itself. Instead, those skilled in the art may recognize that reference to this plane 101 may provide an ease of understanding of various components of the garment 100, including ascertaining left and/or right sides thereof. By way of non-limiting illustration, a sewing pattern (e.g., including a set of templates) for creating the garment 100 by forming pieces of cloth (e.g., pattern pieces which are cut using these templates) may be organized based on forming part of a left side or a right side of the garment 100 as separated by an imaging garment sagittal plane 101. In some implementations, however, the garment sagittal plane 101 may be realized as one or more seams on the garment 100 such that the plane is identifiable by these one or more seams.

The body 300 may have a left side and a right side divided by the garment sagittal plane 101. The left side of the body 300 may include a left sleeve 302. The right side of the body 300 may include a right sleeve 304. The body 300 may include one or more pockets. The one or more pockets may include one or more of left sleeve pocket 306, center pocket 308 (also referred to as a "kangaroo" pocket), right sleeve pocket 310, and/or other pockets. Although the pockets are shown with particular configurations and at particular locations on the garment 100, this is for illustrative purposes only, as a quantity, size, configuration, and/or placement of pockets may vary based on design needs.

Although the shoulder yoke 200 and body 300 are described separately as divisible components of the garment 100, this is for illustrative purpose only. Instead, in some implementations, these components (or parts thereof) may comprise a single continuous component undivided by seams and/or other method of affixation. By way of non-limiting illustration, the shoulder yoke 200 and a portion of the body 300 not including the left sleeve 302 and right sleeve 304 may be one or more pieces of fabric. The left sleeve 302 and right sleeve 304 may be affixed to the body 300 by sewing at respective seams.

In FIGS. 1 and 2, the hood 102 may be affixed to the shoulder yoke 200. The hood 102 may be affixed through one or more of sewing, stitching, gluing, and/or other techniques. In some implementations, the hood 102 may be affixed to the shoulder yoke 200 via a sewn seam 201. However, in other implementations, the hood 102 and shoulder yoke 200 comprise a single continuous component undivided by seams and/or other method of affixation.

The hood 102 may be formed from one or more layers. By way of non-limiting illustration, the hood 102 may be formed by one or more of an inner fabric layer 104, an outer fabric layer 106, perimeter portion 108, and/or other components. The inner fabric layer 104 and outer fabric layer 106 may be affixed at one or more of the seam 201, a hood seam 110, and/or other seams (e.g., a seam at hood sagittal centerline 114). The perimeter portion 108 may extend from the hood seam 110 to a perimeter edge 112. The perimeter edge 112 and/or perimeter portion 108 may define a hood opening. The hood 102 may have a hood sagittal centerline 114 aligned with the garment sagittal plane 101.

The perimeter portion 108 may define an interior channel (not shown in the figures) configured to receive a drawstring 103. The perimeter portion 108 may have one or more eyelets from which the drawstring 103 exits the interior channel.

The hood 102 may have a hood shape. The hood shape may be spherical, rounded, and/or dome-like. The hood shape may include a bulbous, outward-curving contour. The hood 102 may have a continuous lip, e.g., the perimeter portion 108 of the hood 102 may form the continuous lip. By way of non-limiting illustration, the perimeter portion 108 may form a smooth, unbroken edge that wraps evenly around the face opening. The continuous lip may be seamless and/or may include a single top seam formed via the seam at hood sagittal centerline 114. In contrast, a typical sweatshirt hood may have a split forward lip, divided at a center by a seam where the two halves of the hood meet, typically near the bottom where a drawstring exits via left and right eyelets. The typical hood is a result of its stitched fabric construction, where separate panels are sewn together, creating a visible bottom join (often overlapping), instead of a continuous contour of the present hood 102.

The hood 102 may have eye cover 116. The eye cover 116 may be affixed to the inner fabric layer 104 of the hood 102 at a cover seam 132 (not shown in FIG. 1; see, e.g., FIG. 3). The cover seam 132 may not be visible from an exterior side of the outer fabric layer 106. The cover seam 132 may not be visible from an exterior side of the outer fabric layer 106 by virtue of affixation of the eye cover 116 to the inner fabric layer 104. The eye cover 116 may have a cover sagittal centerline 120. In the assembled garment 100, the eye cover 116 may be aligned with the garment sagittal plane 101. The eye cover 116 may be affixed to the inner fabric layer 104 such that the cover sagittal centerline 120 may be aligned with the hood sagittal centerline 114.

The cover sagittal centerline 120 and the hood sagittal centerline 114 described herein may refer to imaginary lines that may not be realized in any particular form on the garment 100 itself. Instead, those skilled in the art may recognize that reference to these centerlines are provided for an ease of understanding of various components of the garment 100, including ascertaining left and/or right sides thereof and/or for aligning various components in the assembly of the garment 100. By way of non-limiting illustration, a sewing pattern (e.g., including a set of templates) for creating the garment 100 by forming pieces of cloth (e.g., pattern pieces which are cut using these templates) may be organized based on forming part of a left side or a right side of the garment 100 as separated by the cover sagittal centerline 120 and/or the hood sagittal centerline 114. In some implementations, however, the cover sagittal centerline 120 and/or hood sagittal centerline 114 may be realized as one or more seams on the garment 100 such that the centerline(s) is/are identifiable by these one or more seams. By way of non-limiting illustration, the hood sagittal centerline 114 may correspond to an actual seam which divides the outer fabric layer 106 into left and right sides which are then affixed together. By way of non-limiting illustration, the cover sagittal centerline 120 may be an imaginary line which divides the eye cover 116 into left and right sides but is not realized by any particular physical element on the cover.

The eye cover 116 may have a deployed mode. In the deployed mode, such as in FIGS. 1-3, the eye cover 116 may be positioned to cover the eyes of the wearer.

The eye cover 116 may have a stored mode. In the stored mode, the eye cover 116 may be laid up against the inner fabric layer 104 toward a top of the hood 102. In the stored mode, and when the garment 100 is in use, the eye cover 116 may be positioned between the inner fabric layer 104 and a top of a wearer's head. The affixation of the eye cover 116 to the inner fabric layer 104 (e.g., a contour of cover seam 132) may cause eye cover 116 to be biased toward the stored mode.

In some implementations, the eye cover 116 may be transitioned from the deployed mode to the stored mode by rotation about the cover seam 132. By way of non-limiting illustration, to transition from the stored mode to the deployed mode, the user may rotate the eye cover 116 downward. To transition from the deployed mode to the stored mode, the user may rotate the eye cover 116 up into the hood 102.

The eye cover 116 may include one or more elements. The eye cover 116 may include one or more of a left eye portion 122, a right eye portion 124, a bridge portion 126, a top edge 132 (not shown in FIG. 1), a bottom edge 118, a medial point 134 (not shown in FIG. 1), a first lateral point 130, a second lateral point 128, and/or other elements. The bottom edge 118 may have a shape which contours one or more of left eye portion 122, the right eye portion 124, the bridge portion 126, and/or other portions.

The bridge portion 126 may be shorter than the left and/or right eye portions to accommodate a nose bridge of a wearer. The bridge portion 126 may contour in other ways to accommodate a nose bridge of a wearer.

The lateral points may be points where the top edge 132 and the bottom edge 118 meet. The first lateral point 130 may be on the left side, and the second lateral point 128 may be on the right side.

Figure 3:
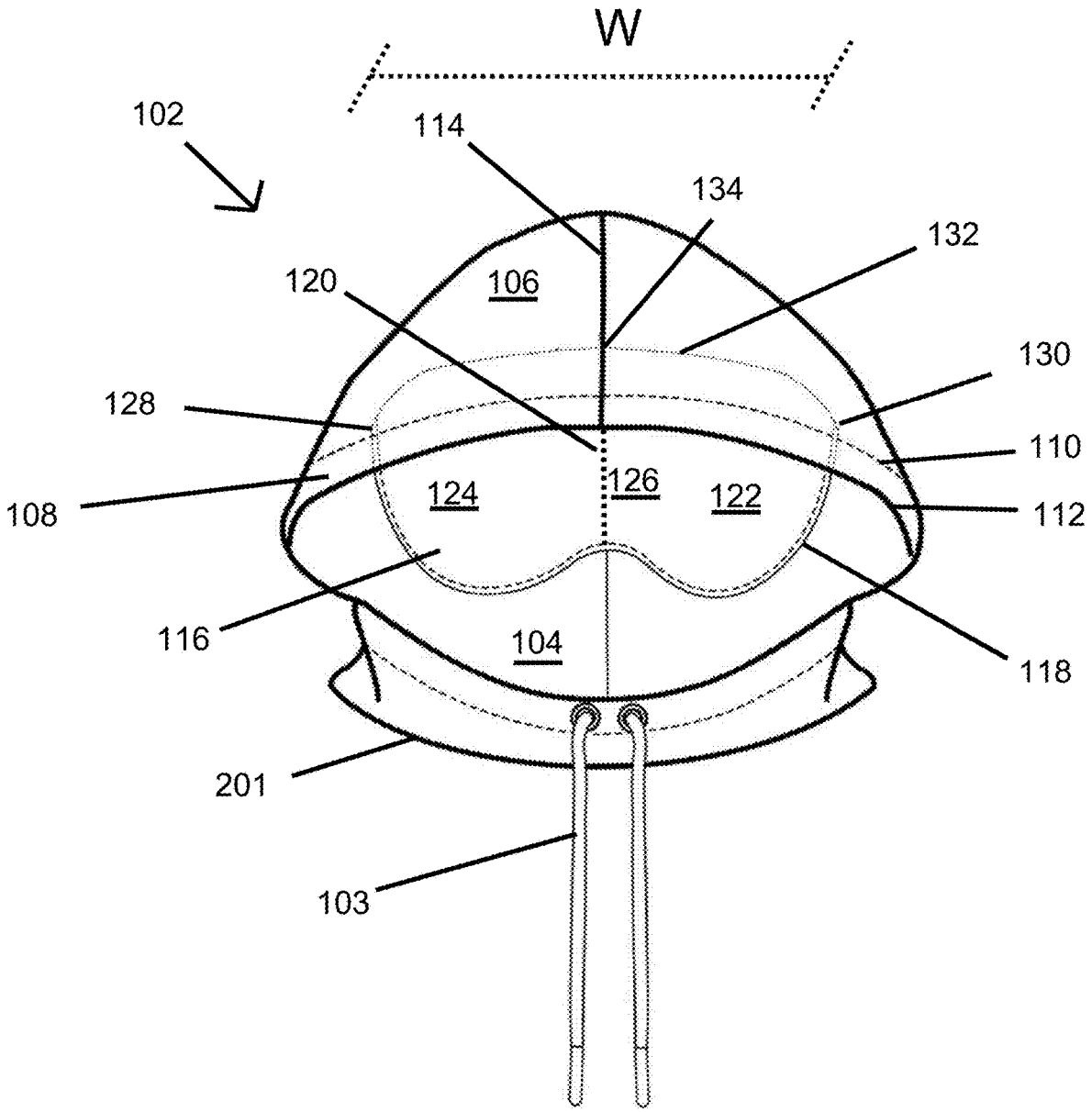
FIG. 3 illustrates a front view of a hood of a hooded garment, in accordance with one or more implementations.

FIG. 3 shows (via dashed lines illustrating portions hidden from view) the cover seam 132 formed at the top edge 132 (labeled via the same numeral), the medial point 134, the first lateral point 130, the second lateral point 128, and/or other elements of eye cover 116. It is noted that FIG. 3 depicts the hood 102 with the fabric in a relaxed state (e.g., the top is slumped down, and the sides are protruding).

The top edge 132 may be opposite the bottom edge 118. The top edge 132 may be sewn into the inner fabric layer 104 forming the cover seam 132. The top edge 132 may have a segmented arch shape and/or other shapes. The segmented arch shape may span one or more of the left eye portion 122, the right eye portion 124, the bridge portion 126, and/or other portions. The medial point 134 may be a top point or apex of the top edge 132 that intersects with the cover sagittal centerline 120 and/or hood sagittal centerline 114.

The cover seam/top edge 132 may contour from the medial point 134 to the first lateral point 130 on a left side of the eye cover 116 (e.g., that would cover the wearers left eye). The cover seam/top edge 132 may contour from the medial point 134 to the second lateral point 128 on a right side of the eye cover 116 (e.g., that would cover the wearer's right eye).

The eye cover 116 may have a width, W. The width W may be measured from the first lateral point 130 to the second lateral point 128. In some implementations, width W may be in a range of 20 to 36 centimeters. In some implementations, width W may be in a range of 27 to 32 centimeters. In some implementations, width W may be about 30 centimeters. In some implementations, width W may be about 29 centimeters.

The eye cover 116 may have a curved width. The curved width may be a measure of a distance from the first lateral point 130 to the second lateral point 128 when the eye cover 116 is under the compression of the hood 102 in an as-used mode (having the curved hood shape and enclosing a wear's head). That is, the curved width may refer to a width of the eye cover 116 when affixed via the cover seam 132 so that a curve is imparted onto the eye cover 116 due to at least the curvature of the shape of the hood 102 and a natural lie of the fabric when worn. The curved width may be less than width W. In some implementations, curved width may be in a range of 22 to 34 centimeters. In some implementations, width W may be in a range of 25 to 30 centimeters. In some implementations, width may be about 26 centimeters. In some implementations, width may be about 25 centimeters.

The eye portions 122 and/or 124 may be defined by a height and/or width. In some implementations, the height may be in a range of 10 to 16 centimeters. In some implementations, height may be in a range of 11 to 14 centimeters. In some implementations, width may be about 12 centimeters. In some implementations, width may be about 12.5 centimeters.

The bridge portion 126 may be defined by a height and/or width. In some implementations, height may be in a range of 7 to 13 centimeters. In some implementations, height may be in a range of 10 to 11 centimeters. In some implementations, width may be about 11 centimeters. In some implementations, width may be about 10 centimeters.

The eye cover 116 may be affixed to the inner fabric layer 104 such that the eye cover 116 may be set back from the perimeter portion 108. By way of non-limiting illustration, the setback of the eye cover 116 from the perimeter portion 108 may cause the cover seam 132 (formed by affixation of the eye cover 116 to the inner fabric layer 104) to be separate and distinct from the hood seam 110.

Figure 4:
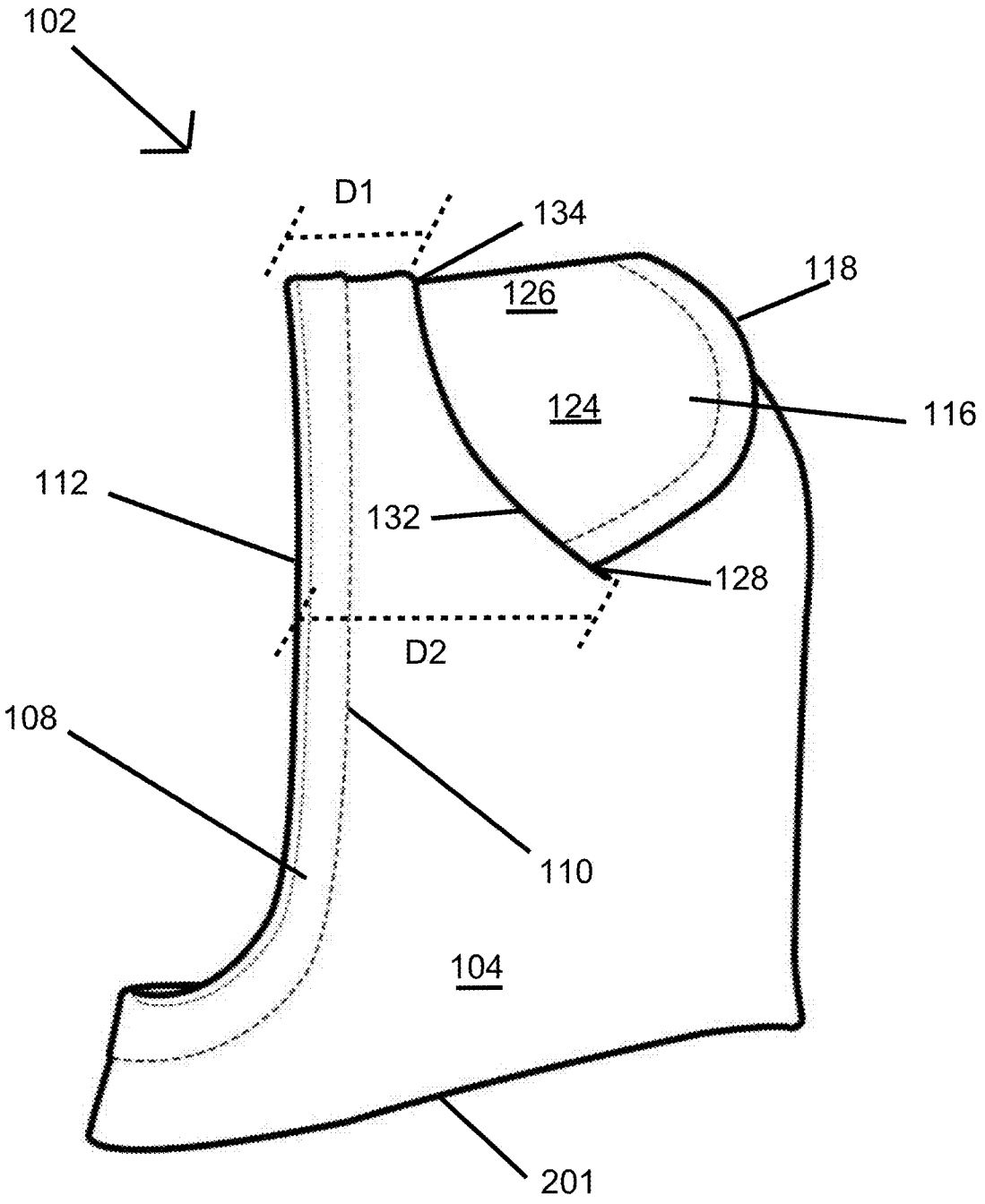
FIG. 4 illustrates a side view of a hood of a hooded garment flipped inside out to show placement and contour of an eye cover, in accordance with one or more implementations.

FIG. 4 is a view of the hood 102 reversed (e.g., inside out) to further illustrate the positioning of the eye cover 116, separation between the cover seam 132 and the hood seam 110, and/or contour of cover seam/top edge 132. In some implementations, the setback may be measured by straight line distances to the perimeter edge 112 and/or other portion.

By way of non-limiting illustration, the eye cover 116 may be set back from the perimeter edge 112 such that the medial point 134 of the eye cover 116 may be a first distance, D1, from the perimeter edge 112. In some implementations, D1 may be in a range of 4 to 8 centimeters. In some implementations, D1 may be in a range of 5 to 7 centimeters. In some implementations, D1 may be in a range of 5.5 to 6 centimeters. In some implementations, D1 may be about 5.5 centimeters. In some implementations, D1 may be about 5.7 centimeters.

The second lateral point 128 (and/or first lateral point 130 not shown in FIG. 4) may be a second distance, D2, from the perimeter edge 112. In some implementations, D2 may be in a range of 10 to 14 centimeters. In some implementations, D2 may be in a range of 12 to 13 centimeters. In some implementations, D2 may be in a range of 12.5 to 13 centimeters. In some implementations, D2 may be about 12.5 centimeters. In some implementations, D2 may be about 12.7 centimeters.

In some implementations, D2 may be more than twice D1. In some implementations, D2 may be about twice D1.

In some implementations, the hood 102 may be formed based on a ratio of D2 to D1 (e.g., D2:D1) having a certain value. By using a ratio as a constraint, the actual size and/or dimension of the hooded garment 100 may be adjusted (e.g., increased or decreased) as needed to fit a certain size garment, while still adhering to this constraint.

In some implementations, the ratio D2:D1 may be in the range of 2:1 to 3:1. In some implementations, the ratio D2:D1 may be in the range of 2.1:1 to 2.5:1. In some implementations, the ratio D2:D1 may be about 2:1. In some implementations, the ratio D2:D1 may be about 2.2:1. In some implementations, the ratio D2:D1 may be about 2.5:1. By way of non-limiting illustration, D1 may be 5.7 centimeters and D2 may be 12.7 centimeters. Other ratios may be considered, such as W:D1 and/or W:D2.

Figure 5:
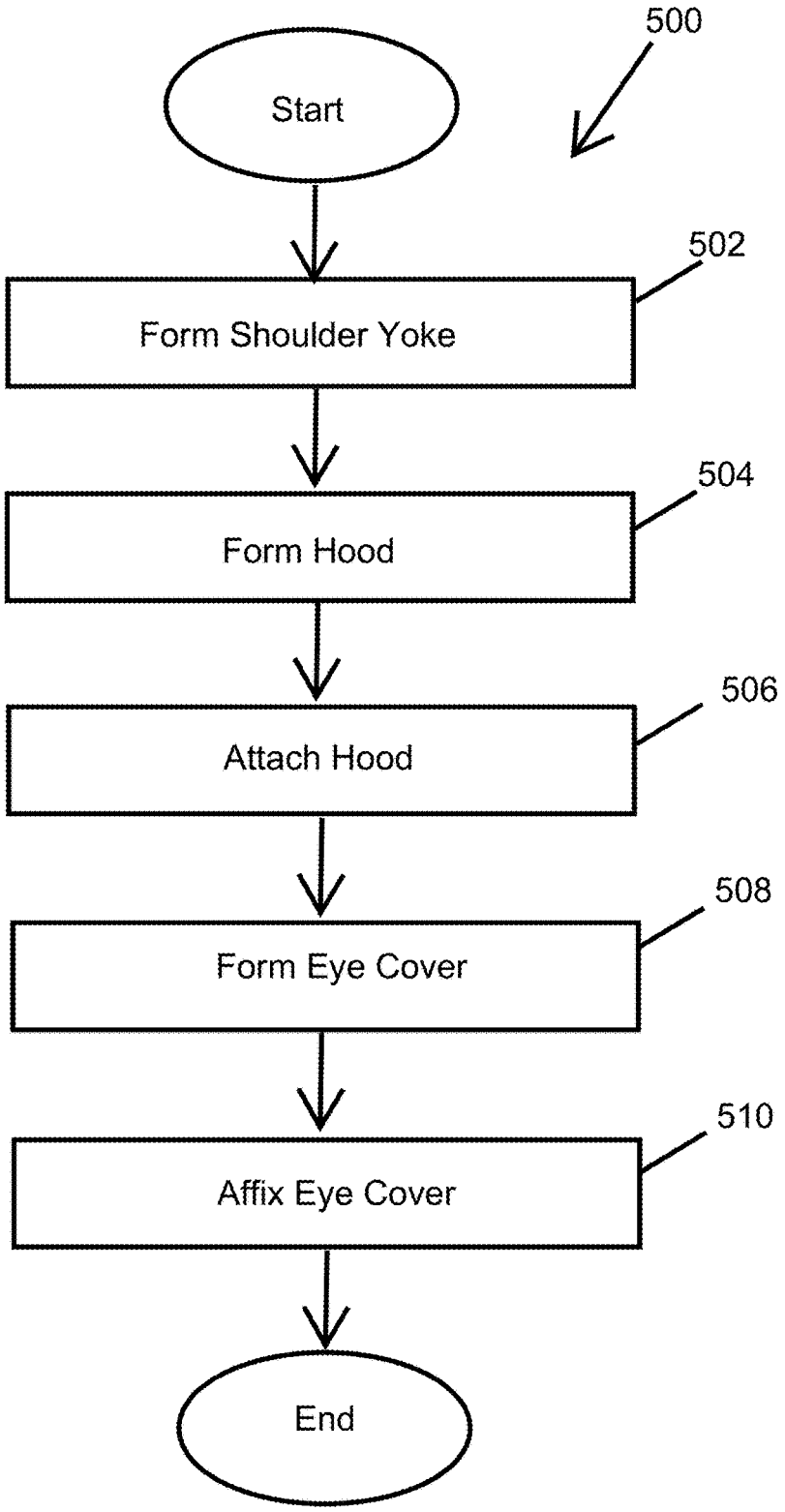
FIG. 5 illustrates a method of manufacture of a hooded garment, in accordance with one or more implementations.

FIG. 5 illustrates a method 500 of manufacture of a hooded garment with eye cover, in accordance with one or more implementations. The operations of method 500 presented below are intended to be illustrative. In some implementations, method 500 may be accomplished with one or more additional operations not described, and/or without one or more of the operations discussed. Additionally, the order in which the operations of method 500 are illustrated in FIG. 5 and described below is not intended to be limiting.

In some implementations, method 500 may be implemented using manual and/or automated manufacturing techniques. Manual manufacturing techniques may include one or more forming techniques used by skilled artisans in garment and/or textile design and/or manufacture. A forming technique may include one or more of cutting, sewing, stitching, glueing, and/or other techniques. Other techniques known to skilled artisans in garment and/or textile design and/or manufacture are also within the scope of the present disclosure. An automated manufacturing technique may include one or more machines and/or one or more processing devices. The one or more processing devices and/or one or more machines may include one or more devices executing some or all of the operations of method 500 in response to instructions stored electronically on an electronic storage medium. Machines may include one or more of sewing machines, automatic pattern stamping machines, laser cutting machines, robotics, and/or other machines suitable for the intended purposes described and/or made apparent herein. The one or more processing devices and/or machines may include one or more devices configured through hardware, firmware, and/or software to be specifically designed for execution of one or more of the operations of method 500.

An operation 502 may include forming a shoulder yoke. The shoulder yoke may have an opening formed for a neck of a user. The shoulder yoke may have a left side and a right side divided by a garment sagittal plane.

An operation 504 may include forming a hood. The hood may have an inner fabric layer and an outer fabric layer affixed at a hood seam. The hood may further have a perimeter portion extending from the hood seam to a perimeter edge defining a hood opening. The hood may have a hood sagittal centerline aligned with the garment sagittal plane.

An operation 506 may include affixing the hood to the shoulder yoke.

An operation 508 may include forming an eye cover.

An operation 510 may include affixing the eye cover to the inner fabric layer of the hood at a cover seam. The eye cover may have a cover sagittal centerline aligned with the garment sagittal plane. The eye cover may be affixed such that the cover sagittal centerline is aligned with the hood sagittal centerline. The eye cover may be affixed such that the eye cover is set back from the perimeter portion. The cover seam formed by affixation of the eye cover to the inner fabric layer may be separate and distinct from the hood seam.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A hooded garment with an eye cover, the hooded garment comprising:

a shoulder yoke having an opening formed for a neck of a user, the shoulder yoke having a left side and a right side divided by a garment sagittal plane;

a hood attached to the shoulder yoke, the hood having an inner fabric layer and an outer fabric layer attached at a hood seam, the hood further having a perimeter portion extending from the hood seam to a perimeter edge defining a hood opening, the hood having a hood sagittal centerline aligned with the garment sagittal plane; and the eye cover, the eye cover being affixed to the inner fabric layer of the hood at a cover seam, the eye cover having a cover sagittal centerline aligned with the garment sagittal plane, such that:

the cover sagittal centerline is aligned with the hood sagittal centerline;

the eye cover is set back from the perimeter portion such that the cover seam formed by affixation of the eye cover to the inner fabric layer is separate and distinct from the hood seam;

wherein the eye cover is set back from the perimeter edge such that a medial point of the eye cover is a first distance from the perimeter edge;

wherein the cover seam contours from the medial point to a first lateral point on a right side of the eye cover, and from the medial point to a second lateral point on a left side of the eye cover;

wherein the first lateral point is a second distance from the perimeter edge; and wherein the second distance from the perimeter edge to the first lateral point is more than twice the first distance from the perimeter edge to the medial point.

2. The hooded garment of claim 1, wherein the first distance is in a range of 5.5 to 6 centimeters.

3. The hooded garment of claim 2, wherein the second distance is in a range of 12.5 to 13 centimeters.

4. The hooded garment of claim 3, wherein the first distance is 5.7 centimeters.

5. The hooded garment of claim 4, wherein the second distance is 12.7 centimeters.

6. The hooded garment of claim 1, wherein the eye cover includes a left eye portion, a right eye portion, and a bridge portion.

7. The hooded garment of claim 6, wherein the eye cover includes a bottom edge having a shape which contours the left eye portion, the right eye portion, and the bridge portion.

8. The hooded garment of claim 7, wherein the eye cover includes a top edge opposite the bottom edge, wherein the top edge has a segmented arch shape that spans the left eye portion, the right eye portion, and the bridge portion.

9. The hooded garment of claim 6, wherein the left eye portion and the right eye portion have a height in a range of 10 to 16 centimeters.

10. The hooded garment of claim 6, wherein the bridge portion has a height in a range of 7 to 13 centimeters.

11. The hooded garment of claim 1, wherein the eye cover has a width in a range of 27 to 32 centimeters.

12. The hooded garment of claim 1, wherein the perimeter portion forms a continuous lip.

13. The hooded garment of claim 12, wherein the perimeter portion defines an interior channel configured to receive a drawstring.

14. The hooded garment of claim 1, wherein the eye cover is configured to transition between a deployed mode covering eyes of the user and a stored mode wherein the eye cover is laid against the inner fabric layer.

15. The hooded garment of claim 14, wherein in the stored mode, the eye cover is configured to be positioned between the inner fabric layer and a top of a head of the user.

16. The hooded garment of claim 1, wherein the eye cover has a curved width in a range of 22 to 34 centimeters when the eye cover is affixed via the cover seam such that a curve is imparted onto the eye cover.

17. The hooded garment of claim 1, further comprising a body extending from the shoulder yoke, wherein the body includes a left sleeve and a right sleeve.

* * * * *